United States Patent [19]

Berner

[11] 3,985,603

[45] Oct. 12, 1976

[54] METHOD AND APPARATUS FOR TRANSPORTATION OF A LABEL

[75] Inventor: George J. Berner, Beavercreek Township, Greene County, Ohio

[73] Assignee: Hobart Corporation, Troy, Ohio

[22] Filed: June 16, 1975

[21] Appl. No.: 587,059

[52] U.S. Cl. ..... 156/235; 156/238; 156/247; 156/344; 156/541; 156/584; 156/DIG. 33

[51] Int. Cl.[2] ..... B65C 9/18

[58] Field of Search ..... 156/540, 541, 542, 344, 156/384, 584, 566, 230, 235, 238, 247, 289, DIG. 33; 221/73; 271/6, 7, 4, DIG. 2

[56] References Cited

UNITED STATES PATENTS

| | | | |
|---|---|---|---|
| 3,006,502 | 10/1961 | Tobey | 221/73 |
| 3,169,895 | 2/1965 | Sohn | 156/541 |
| 3,321,105 | 5/1967 | Marano | 156/542 |
| 3,447,992 | 6/1969 | Allen et al. | 156/584 |
| 3,530,028 | 9/1970 | Messmer | 156/584 |
| 3,537,933 | 11/1970 | Severance | 156/541 |
| 3,556,898 | 9/1967 | Allen | 156/384 |

*Primary Examiner*—William A. Powell
*Assistant Examiner*—Michael W. Ball
*Attorney, Agent, or Firm*—Biebel, French & Nauman

[57] ABSTRACT

Apparatus for carrying a label having a pressure sensitive adhesive on one side from a first station where the label is printed and partially removed from a strip of backing material to a second, remote station where the label is to be applied to a package includes a belt conveyor extending between the first and second stations. The conveyor moves into direct engaging contact with the label after the label is partially removed from the backing material such that the label is then completely stripped from the backing material and firmly engaged by the conveyor. The conveyor is then driven to move the label to the second station.

6 Claims, 13 Drawing Figures

METHOD AND APPARATUS FOR TRANSPORTATION OF A LABEL

BACKGROUND OF THE INVENTION

The present invention relates to a method and apparatus for handling labels having one side coated with a pressure sensitive adhesive. The present invention is particularly suited for use with weighing and labeling apparatus used in super markets and grocery stores for determining the weight and total value of random weight items. Labels of the type transported in the present invention may typically have a bar coded pattern such as the Universal Product Code (UPC) specifying the type of product and the total cost of the product printed thereon. The bar code pattern for pre-packaged goods is typically printed on the product package. Since, however, between 10 and 30% of items sold in grocery stores are random weight items, (e.g., meat, produce and cheese), provision for the application of UPC labels to such products must be made, to allow these items to be processed through the readers at check out counters. It is therefore necessary to transport a label bearing such UPC information from the bar code printer where this information is printed to an applicator where the label is applied to the package. This is true whether the label is to be applied automatically or manually.

Typically such labels may have a pressure sensitive adhesive coating on one side and are held by this coating on a strip of backing material while they are printed. Thus it is necessary and advantageous to provide a method and apparatus for automatically stripping such labels from the backing material and transporting them, with the adhesive exposed, to a point at which they may be applied to a package.

In the past label transport devices have been known, such as that disclosed in U.S. Pat. No. 3,556,898, assigned to the assignee of the present invention. Such a device, however as shown in FIG. 3 of the drawings utilized a conveying mechanism which firmly engaged a label before the label was completely stripped from the backing material on which it is mounted.

SUMMARY OF THE INVENTION

A label transport apparatus for carrying a printed label having a pressure sensitive adhesive on one side thereof, and initially held by said adhesive on a strip of backing material, from a first station where the label is removed from the backing material to a remote second station where the label is deposited, comprises a means defining the first station which includes a sharp edge. The backing material is maintained at the first station in contact with the sharp edge and moves past the sharp edge in such a manner that this backing material makes a sharp turn. This causes the label to be partially stripped from the backing material. A power driven conveyor extends between the first and second stations, to carry individual labels between them. At least that portion of the conveyor adjacent the first station is movable to bring the conveyor into direct engaging contact with a label after it is partially stripped from the backing at the first station. This causes the label to be completely stripped from the backing material and then firmly engaged by the conveyor. Finally the drive for the conveyor is actuated to cause the label to be moved from the first station to the second station.

A small amount of oil may be applied to at least a portion of the conveyor to prevent the label from adhering to the conveyor after the label is transported to the second station, assuring that the label is readily disengaged from the conveyor at the second station.

Accordingly it is an object of this invention to provide a method and apparatus for transporting a label having one side coated with a pressure sensitive adhesive after such label is stripped from a backing material; further to provide such a method and apparatus for partially stripping the label from the backing material by moving the backing material around a sharp edge and causing it to make a sharp turn such that the stiffness of the label causes it to pull away from the backing material rather than follow the backing material around the sharp turn and for moving a conveyor means into direct engaging contact with the label so as to completely strip the label from the backing material; further to provide such a method and apparatus in which the motion of the conveyor means into direct engaging contact not only causes the label to be completely stripped from the backing material but also firmly engages the label such that it is transported by the conveyor means from a first station to a second station; and to provide such a method and apparatus in which only a portion of the conveyor is moved relative to the label.

Other objects and advantages of the invention will be apparent from the following description, the accompanying drawings and the appended claims.

DETAILED DESCRIPTION OF THE PREFERRED EMBODIMENTS

The present invention relates to label handling, and in particular to the transport of labels having one side coated with a pressure sensitive adhesive. Such a label may typically be mounted on a backing material and information printed thereon. The label must then be stripped from the backing material and transported individually to a remote location where it will be applied to a package.

Figure 1:
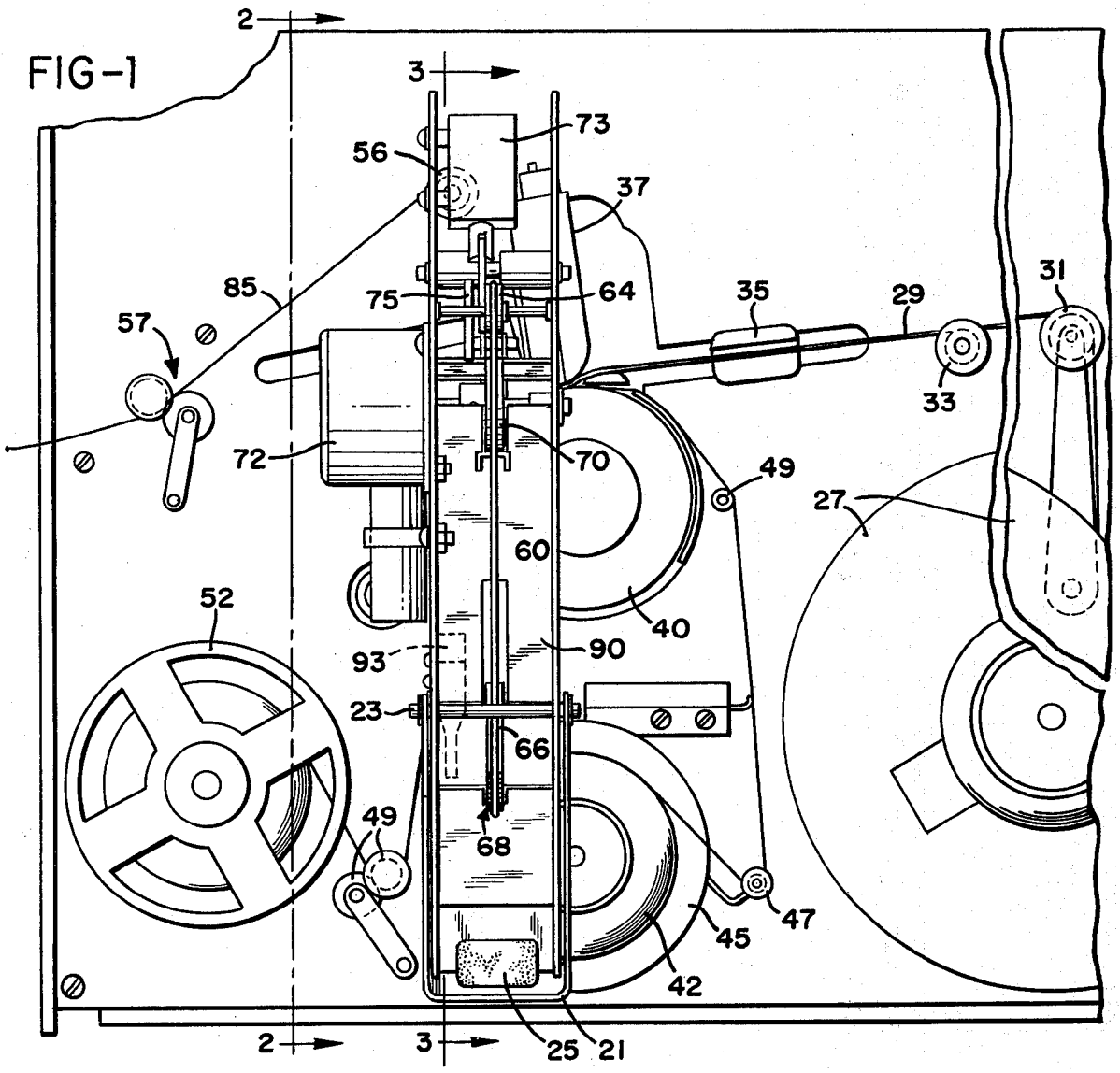
FIG. 1 is a plan view of a portion of a printer and the label transport of the first embodiment of the present invention.
Figure 2:
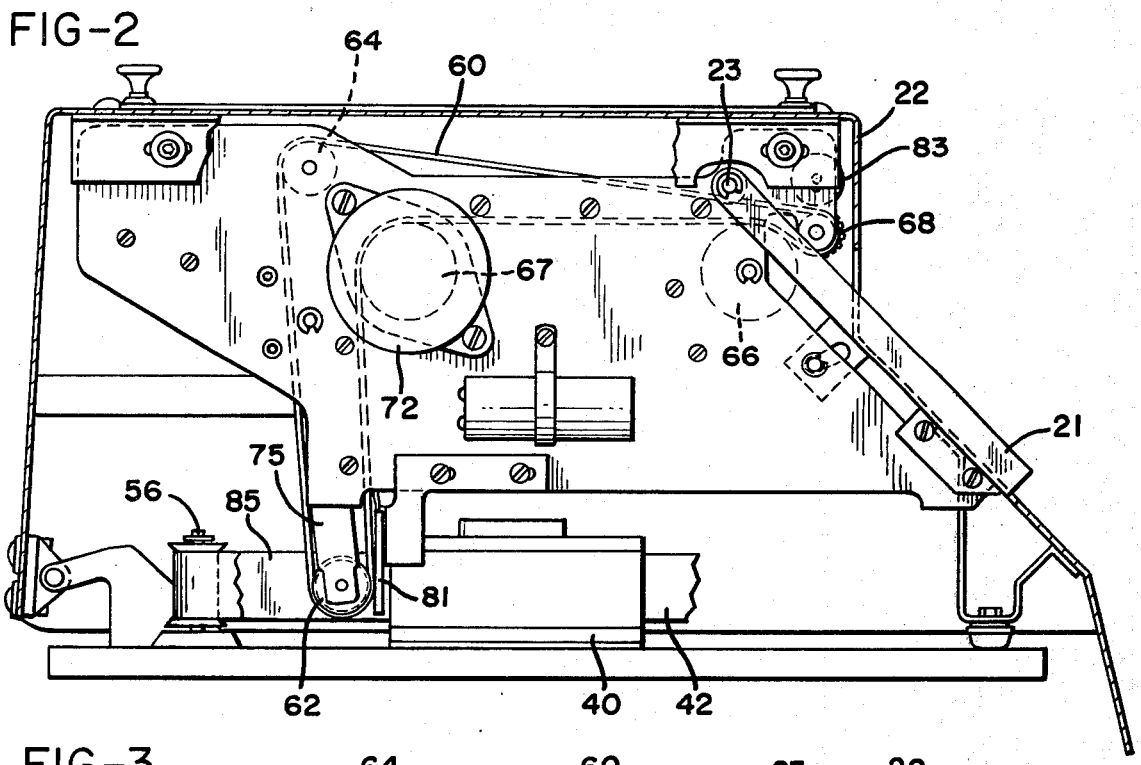
FIG. 2 is a side sectional view of the printer and label transport taken generally along line 2—2 in FIG. 1 with parts of the printer removed.

The first embodiment of the invention contemplates manual application to a package of a label having one side coated with a pressure sensitive adhesive. An arrangement for stripping a label from its associated backing material and transporting it is shown in FIG. 1, which is a plan view of the printer and transport apparatus with the cabinet removed. As seen in FIG. 2, a label is presented by the transport apparatus to a chute 21, outside of cabinet 22, where it is held prior to being applied to the package. When the label is to be applied, the package is pressed against chute 21, causing the chute to rotate about hinge 23 as the label 25 is applied to the package.

The printer mechanism shown in the drawings may be of the type commercially available from Interface Mechanisms, Inc., Mountlake Terrace, Wash., and disclosed generally in U.S. Pat. Nos. 3,866,851, issued on Feb. 18, 1975, and U.S. Pat. No. 3,874,288 issued on Apr. 1, 1975. Supply reel 27 holds a roll of blank label stock. This stock consists of a series of labels held by a pressure sensitive adhesive on a backing material. These labels do not abut each other on the strip of backing material, but are separated by a series of short gaps of uniform length. The blank label stock 29 is threaded around tensioning arm 31 and guide roller 33. The stock then moves past photo pick-up 35 which detects the short gaps between labels and thus determines label position relative to print head 37.

Figure 7:
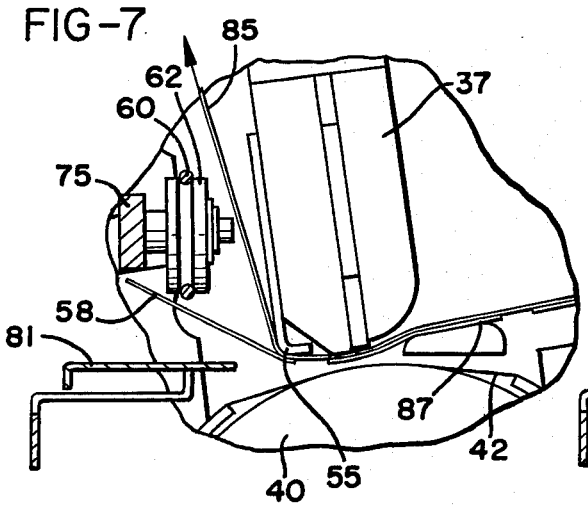
FIG. 7 is an enlarged partial sectional view of the printer and pick-up portion of the transport taken generally along line 7—7 in FIG. 3 prior to engaging a label.

Character wheel 40 is positioned near print hammer 37 and has the appropriate UPC bar code formed on its periphery. Character wheel 40 is constantly rotated by a motor mechanism (not shown). An ink ribbon 42 from ribbon supply reel 45 is threaded around tension arm 47 and guide roller 49, and past character wheel 40. The used ink ribbon then is threaded through a powered ribbon drive assembly 49 and received onto take-up reel 52. As the blank label stock 29 moves between the print hammer 37 and the rotating character wheel 40, the hammer is activated at appropriate times to compress blank label stock 29 and the ink ribbon 42 against the print wheel 40 and thus print the desired code on a label. After the label and associated backing material passes print hammer 37, the backing material is caused to pass around sharp edge 55, making a sharp turn and abrupt change in direction. As shown in FIG. 7, the label 58 is partially stripped from the backing material as the relatively stiff label pulls away from the backing material rather than following the material around the sharp turn. The strip of backing material 85 is maintained in contact with the sharp edge 55 and passes around guide roller 56 and through drive assembly 57.

As seen in FIG. 2, a label transport arrangement is provided for carrying a printed label from a first station adjacent the character wheel 40 and the print hammer 37 and including sharp edge 55, to a second station including chute 21 exterior to the printer cabinet 22 where the label is received. The conveyor means which is drivable between the first and second stations includes belt 60 which may typically be made of an elastomeric material and have a circular cross section approximately 1/20 of an inch in diameter. The belt is capable of being stretched under tension and thereafter returning to its original length. Belt 60 is formed into an endless loop and passes around free running pulleys 62, 64, 66, drive wheel 67 and toothed wheel 68.

The means for driving the conveyor means comprises permanent magnet alternating current motor 72 which is connected to drive wheel 67. A means for moving the conveyor means may comprise solenoid 73 which is attached to lever arm 75. A spring 77 biases lever arm 75 into a first position shown by the dashed lines in FIG. 3. Off-center cams 79 are provided to adjust the limits of motion of lever arm 75. When solenoid 73 is actuated, lever arm 75 is moved into a second position, shown by the solid lines in FIGS. 3 and 4, in which the conveyor belt abuts a backing plate 81.

Figure 5:
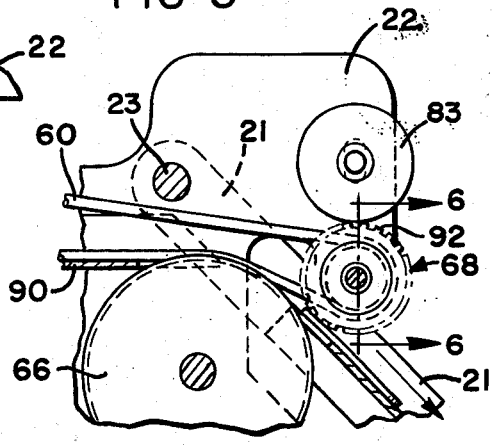
FIG. 5 is an enlarged partial view of the discharge portion of the label transport mechanism.
Figure 6:
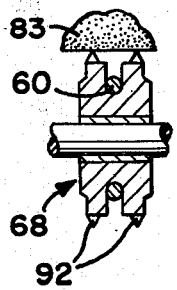
FIG. 6 is an enlarged partial sectional view of the transport mechanism taken generally along line 6—6 in FIG. 5.

The discharge end of the conveyor means adjacent chute 21 is shown in FIG. 5. Belt 60 passes around a knurled wheel 68, the inside diameter of which is less than its outside diameter. Wheel 68 generally abuts rubber wheel 83, as shown in FIG. 6. Wheel 83 may typically be impregnated with a silicone oil lubricant.

Operation of the transport apparatus comprising the first embodiment is as follows. A label is printed by the cooperative action of print head 37, print wheel 40 and ink ribbon 42. When the printing of such a label is completed, the relative positions of the conveyor belt 60, pulley 62, plate 81 and label 58 are as shown in FIG. 7. It will be noted that a small portion of label 58 remains adhering to backing material 85 near the sharp edge defined at 55. Advancing the backing material to the position shown in FIG. 7 also causes the succeeding label 87 to be positioned appropriately for the initiation of the next printing operation.

Figure 8:
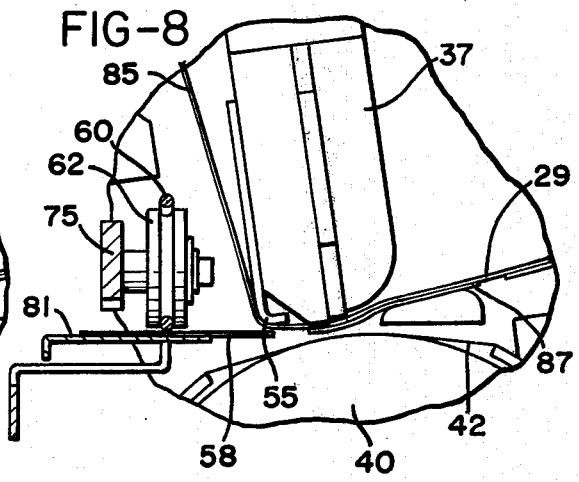
FIG. 8 is an enlarged partial sectional view of the printer and pick-up portion of the transport after engaging the label taken generally along line 7—7 in FIG. 3.
Figure 3:
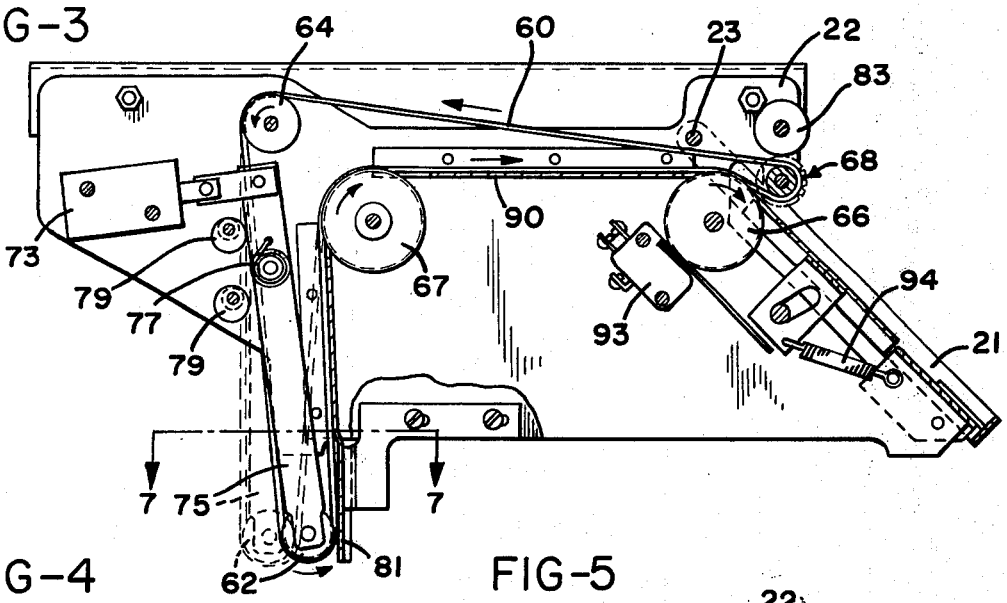
FIG. 3 is a side sectional view of the label transport taken generally along line 3—3 in FIG. 1.
Figure 4:
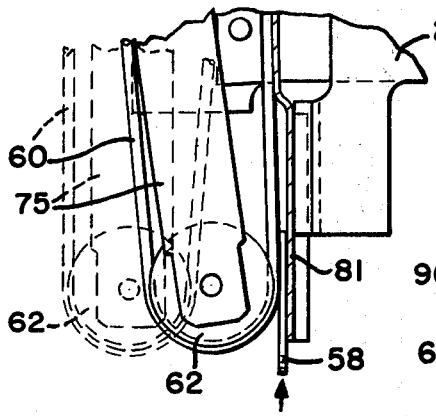
FIG. 4 is an enlarged partial view of the pick-up section of the transport mechanism.

Solenoid 73 is then actuated, causing lever 75 to rotate against the biasing force of spring 77. Pulley 62 and belt 60 are moved into engagement with label 58 as shown in FIGS. 3, 4 and 8. This motion of the conveyor means initially causes label 58 to be rotated about an axis generally defined by edge 55. This rotation results in the completion of the stripping operation such that label 58 is completely removed from backing material 85. The motion of pulley 62 and belt 60 then continues, causing label 58 to be compressed between belt 60 and backing plate 81. Since the adhesive coating of label 58 is facing belt 60, the label will adhere to belt 58.

Simultaneously with the actuation of solenoid 73 and the resultant stripping and engagement of the label 58 by the conveyor means, motor 72 is energized and the belt 60 begins to move as indicated by the arrows in FIG. 3. Thus, immediately after being engaged by belt 60, the label moves upwardly with the belt and passes between the belt 60 and drive wheel 70. The label is then transported along chute 90 until it reaches knurled wheel 68.

As can be seen in greater detail from FIGS. 5 and 6, knurled wheel 68 causes the label to be disengaged from belt 60. As the wheel moves into contact with the belt, the knurled edges 92 on the outer diameter of the wheel tend to pull the label away from the belt. These knurled edges are typically made of a porous metal, such as bronze, and are supplied with a lubricating silicone oil from roller 83. Thus the label is pulled free of the belt by knurled edged 92, and will not stick to the outer diameter of wheel 68. The silicone oil applied to wheel 68 also prevents build up of adhesive on the wheel. The label then slides freely down the chute 21 with application of the label to a package is being accomplished by pressing the package against chute 21. As previously mentioned, this also causes chute 21 to rotate about pivot point 23, momentarily actuating switch 93. Chute 21 is caused to return to its initial position by a spring 94. The switch 93 is connected as an interlock switch in the printer control circuitry to prevent printing of a label until the previous label is applied to a package.

Figure 9:
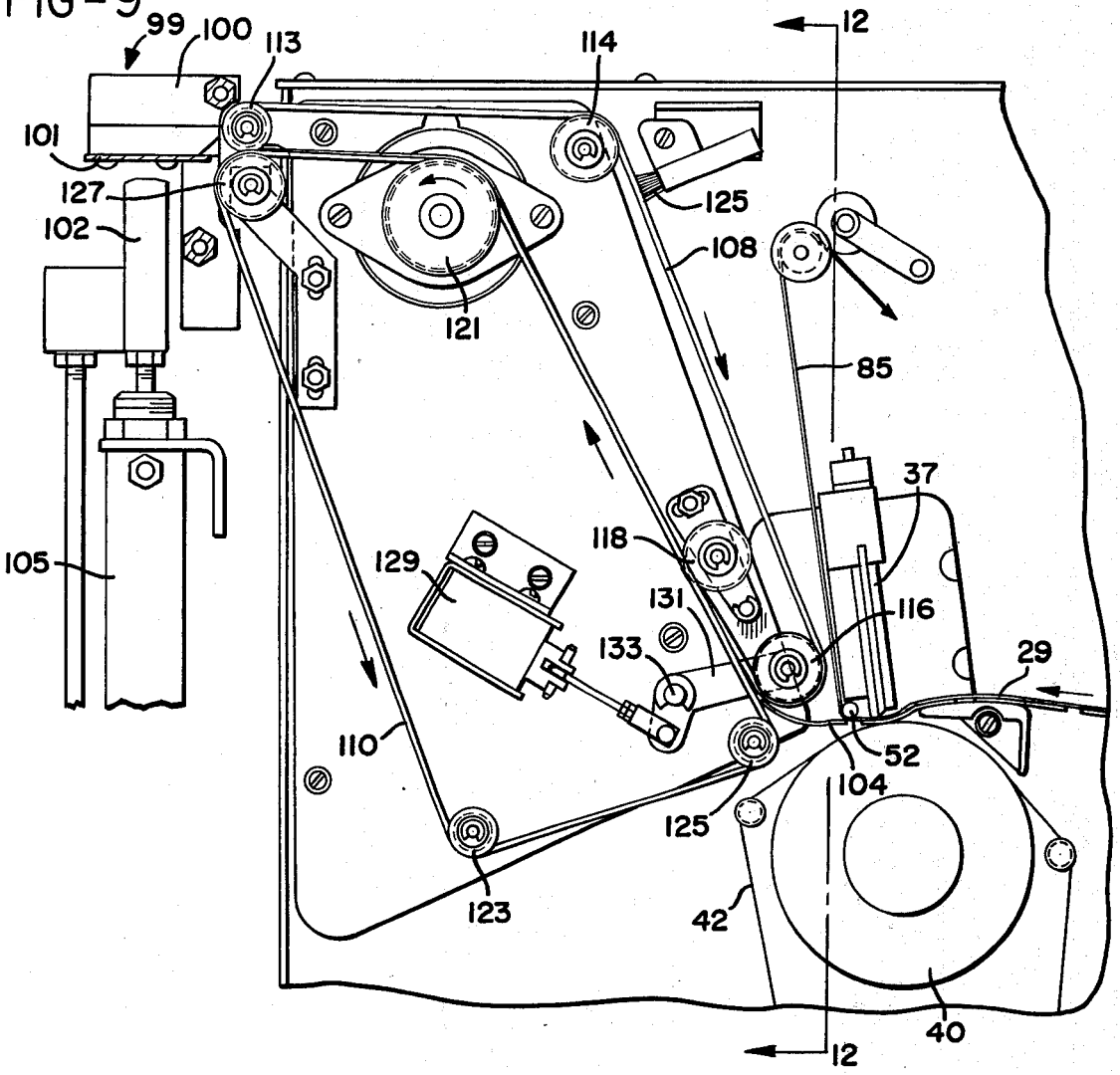
FIG. 9 is a side view of a portion of a printer and the label transport of the second embodiment of the invention.

Referring now to FIGS. 9–12, there is shown a second preferred embodiment of the invention. The label transport mechanism disclosed is intended to be used with a printer of substantially the same design as that shown in FIGS. 1–8. This embodiment of the invention finds particular utility, however, in an automatic weighing and labeling device such as disclosed and claimed in U.S. patent application Ser. No. 573,597, filed Apr. 30, 1975, and assigned to the assignee of the present invention. FIG. 9 is a side elevational view of a portion of the printer and the label transport mechanism. As is apparent from this drawing, the printer is positioned with the rotating elements, such as print wheel 40, rotating in a vertical plane. As with the first preferred embodiment of the invention, the transport mechanism is required to completely remove a pressure sensitive adhesive coated label from its backing material after print hammer 37 and print wheel 40 interact to print the required information on the label and after the label is partially stripped by the movement of the backing material 85 around sharp edge 52. In this embodiment, however, the label is transported away from the first or printing station in the same plane as the movement of the backing material.

The label is transported to an applicator 99 including a catcher mechanism 100 where it is held prior to being engaged by nozzle 102. Catcher 100 is generally comprised of a pair of support edges 101 upon which a label may rest. Nozzle 102 then moves upwardly between the support edges 101 as pneumatic cylinder 105 is extended, with the result that the label is applied to the bottom of a package passing above the applicator 99 on a conveyor (not shown). For a more detailed description of the applicator, reference is made to U.S. patent application Ser. No. 573,597, filed Apr. 30, 1975, and assigned to the assignee of the present invention.

Figure 10:
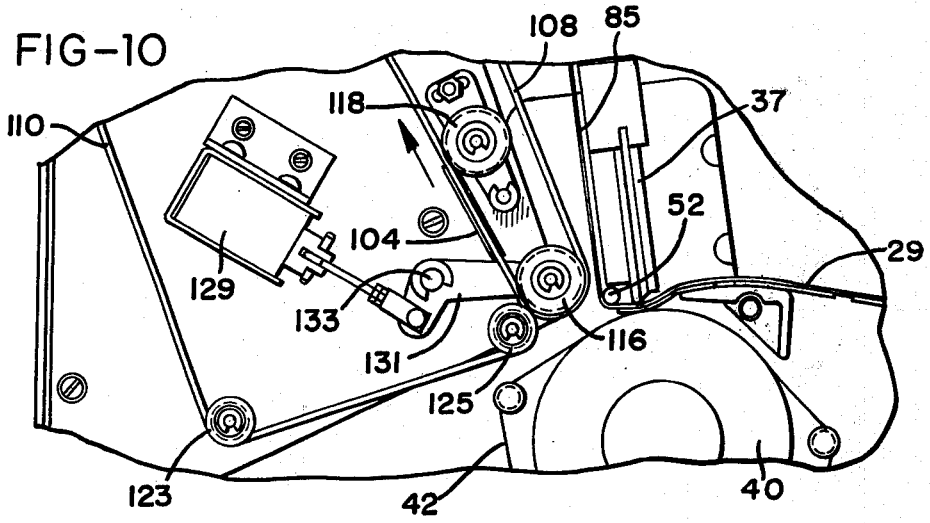
FIG. 10 is an enlarged partial view of the apparatus of FIG. 9 shown engaging a label.
Figure 11:
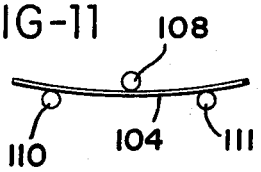
FIG. 11 is an enlarged sectional view taken through the label and the conveyor belts shown in FIG. 10.
Figure 12:
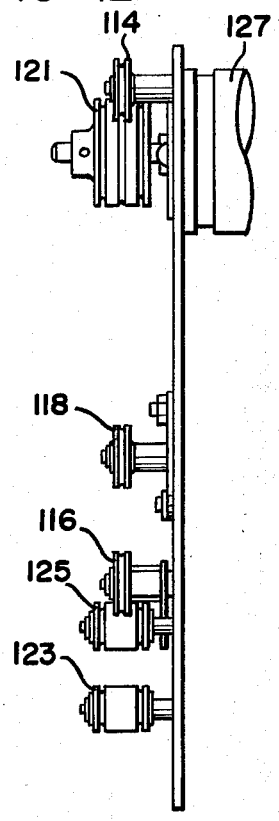
FIG. 12 is an elevational view of the pulley configuration with the conveyor belts removed as seen generally from line 12—12 in FIG. 9.

FIG. 9 shows the transport in its first open position, ready to engage label 104. FIG. 10, a partial view of the pick-up end of the conveyor means, shows the conveyor mechanism in a second position engaging label 104 immediately after stripping it from the backing material. FIG. 11, a sectional view taken of the label and conveyor belts shown in FIG. 10, depicts the manner in which the label is engaged. The label 104 is held between belt 109 and belts 110 and 111. Label 104 is positioned so that the adhesive side faces belt 108. Belt 108, however, is coated with a silicone oil so that the adhesive does not cause the label to adhere to the belt. Thus the label 104 is held by the three belts only through a pinching type of engagement.

As seen in FIG. 9, belt 108 passes around pulleys 113, 114, 116, 118 and drive wheel 121. As with the first preferred embodiment, drive wheel 121 is connected to a motor which acts to drive the conveyor means. Belts 110 and 111 pass around pulleys 123, 125, 127 and drive wheel 121. Solenoid 129 acts to rotate arm 131 about pivot 133 causing pulley 116 to rotate into the position shown in FIG. 10. Pulley 116 is normally biased into the open position shown in FIG. 9 by the tension in belt 108.

As described previously with respect to the first embodiment, after a label is printed, it is partially stripped by the advancement of the backing material around edge 52. The solenoid 129 is then actuated causing pulley 116 to move downwardly and thus rotate the label about an axis generally defined by edge 52. This rotation, as with the first embodiment, strips the label from the backing material. It should be noted that this stripping action is not a result of the conveyor belts being driven but rather is caused by lateral movement of the conveyor means. Further movement of the pulley 116 results in the label being engaged by the conveyor means between belts 108, 110 and 111. Since belt 108 is continuously oiled by wick 125, the engagement is solely a pinching type of engagement. Motor 127 is actuated as the label is engaged, causing the belts to transport the label to applicator 99. As seen from a comparison of FIGS. 9 and 10, only a portion of the conveyor means is moved by solenoid 129 and therefore the solenoid need only be momentarily actuated. After a label passes pulley 118, it will be firmly engaged by the three belts regardless of the position of pulley 116. It should be understood that a secondary conveyor arrangement could be provided to strip labels from the backing material in lieu of moving a portion of the conveyor means relative to the partially stripped labels.

Figure 13:
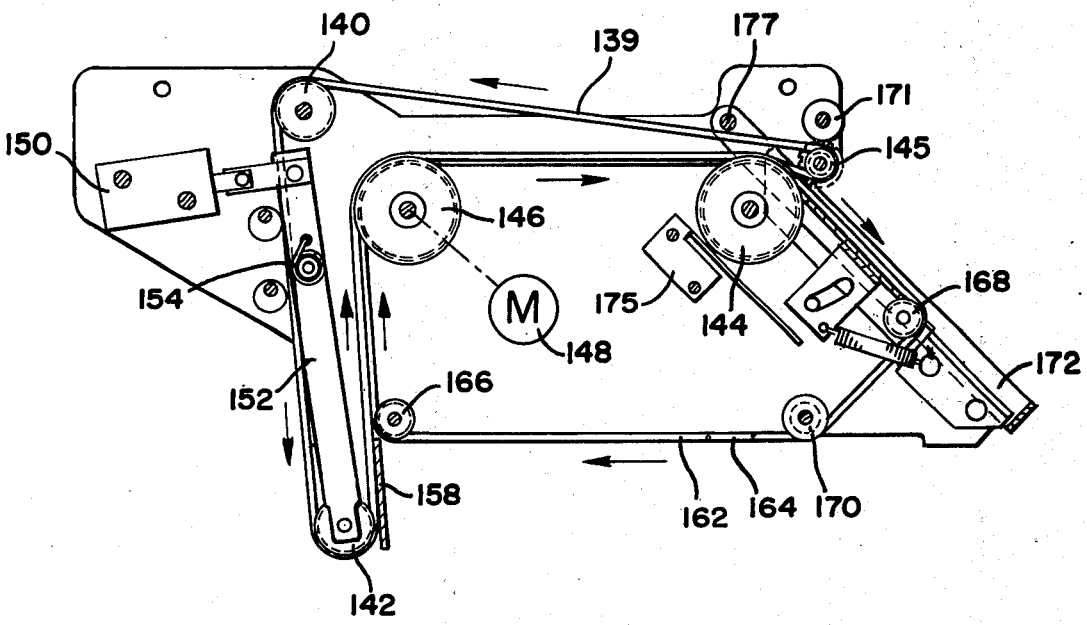
FIG. 13 is a side sectional view of the third embodiment of the invention taken in a manner similar to FIG. 3.

Referring now to FIG. 13, there is shown a third embodiment of the present invention. FIG. 13 is a sectional view taken in a manner similar to FIG. 3. As with the first embodiment, this embodiment is intended to be used with the printer to convey a label to a chute on the exterior of the printer cabinet, where the label may be manually applied to a package. The manner of operation of the third embodiment, however, is quite similar to that of the second embodiment of the invention shown in FIGS. 9–12.

Specifically, the device shown in FIG. 13 is a three-belt arrangement in which the label is trapped between the belts. The label may adhere to the single belt contacting the label on the side having the pressure sensitive adhesive but the transport will function whether this occurs or not. The single belt 139 passes around pulleys 140, 142, 144, knurled wheel 145 and drive wheel 146. As with the previous embodiments, drive wheel 146 is driven by motor 148. The stripping of a label from its backing material and engagement of the label by the conveyor means is accomplished by actuation of solenoid 150. When solenoid 150 is energized, lever 152 is caused to be moved from the position shown in dashed lines in FIG. 13, to which it is biased by spring 154, to the position shown by the solid lines. When in this second position, arm 152 presses a label between belt 139 and plate 158. Whether or not the label adheres to belt 139, the label will engage due to the pressure between the belt 139 and plate 158. The label will therefore move upwardly with belt 139.

Belts 162 and 164 pass around pulleys 166, 168, 170 and 144 as well as drive wheel 146. The various pulleys and drive wheel 148 are so configured as to orient belts 156, 162 and 164 in a manner similar to that shown in FIG. 11, with regard to the second embodiment of the invention. Thus, when a label has been moved by belt 156 to the top of plate 158, it will be engaged by the combined action of the three belts and transported to the top of chute 172. Knurled wheel 145 and oil supply wheel 171 are similar in construction and function to knurled wheel 68 and wheel 83 shown in FIGS. 5 and 6 and act to insure that the label will not adhere to belt 139. Belts 162 and 164 are arranged to move down chute 172 to aid the label in reachng the bottom of the chute 172. Any static electric charge on the label will therefore not prevent it from being transported to the bottom of chute 172. Switch 175 is provided to sense the application of a label to a package as chute 172 is pivoted about point 177.

While the form of apparatus and method herein described constitute preferred embodiments of the invention, it is to be understood that the invention is not limited to this precise method and form of apparatus, and that changes may be made therein without departing from the scope of the invention.

What is claimed is:

1. Label transport apparatus for carrying a printed label having a pressure sensitive adhesive on one side thereof and initially held by said adhesive on a strip of backing material, from a first station where said label is removed from said backing material to a second station, remote from said first station, where said label is deposited, comprising:

means defining the first station including a sharp edge, means at said first station for maintaining the backing material in contact with said sharp edge and moving said backing material past said sharp edge such that said backing material makes a sharp turn at said sharp edge and the label is partially stripped from said backing material, means defining the second station for receiving said label, endless belt conveyor means extending between said first station and said second station and drivable therebetween, means for moving said conveyor means from a first position to a second position to bring said conveyor means into direct engaging contact with the adhesive side of said label after said label is partially stripped at said first station such that said label is completely stripped from said backing material and firmly engaged by said conveyor means, and for returning said conveyor means to said first position, and means for driving said conveyor means such that said conveyor means moves said label from said first station to said second station.

2. The label transport apparatus of claim 1 wherein said means for moving said conveyor means includes motor means for moving only a portion of said conveyor means relative to said label.

3. The label transport apparatus of claim 1 further comprising:

means for applying oil to at least a portion of said conveyor means to prevent said label from adhering to said conveyor means after said label is transported to said second station.

4. The method of removing a label having one side coated with a pressure sensitive adhesive from a backing strip and transporting said label to an applicator, comprising the steps of:

a. moving said backing material with said label affixed thereto around a sharp edge such that said backing material makes a sharp turn and the stiffness of said label causes said label to pull away from said backing material rather than follow said backing material around said sharp turn, b. stopping the movement of said backing material after a substantial portion of said label is stripped from said backing material, c. moving endless belt conveyor means from a first position into contact with the adhesive side of said label to completely strip said label from said backing material, d. continuing the motion of said conveyor such that said label is firmly engaged thereby, and e. conveying said label to the applicator and returning said conveyor means to said first position.

5. The method of claim 4 wherein the step of moving the conveyor means into contact with said label includes the step of moving only a portion of said conveyor means relative to said label.

6. The method of claim 5 wherein the step of moving only a portion of said conveyor means relative to said label includes the step of stretching said conveyor means whereby the tension in said conveyor means returns said portion of said conveyor means to said first position.

* * * * *